United States Patent [19]

Alpers

[11] Patent Number: 4,893,979

[45] Date of Patent: Jan. 16, 1990

[54] SUPPLEMENTAL BOOK COVER

[76] Inventor: Fred W. Alpers, 12485 Rockhaven Rd., Chesterland, Ohio 44026

[21] Appl. No.: 368,970

[22] Filed: Jun. 19, 1989

Related U.S. Application Data

[63] Continuation-in-part of Ser. No. 162,276, Feb. 29, 1988, abandoned.

[51] Int. Cl.[4] ..... B42C 17/00; D42D 3/00

[52] U.S. Cl. ..... 412/4; 281/15.1; 281/21.1; 281/29; 281/34; 281/35

[58] Field of Search ..... 281/15.1, 51, 21.1, 281/29, 35, 36, 37; 412/4, 3, 5

[56] References Cited

U.S. PATENT DOCUMENTS 4,744,592 5/1988 Barnette et al. ..... 281/15 R

*Primary Examiner*—Paul A. Bell

*Attorney, Agent, or Firm*—Pearne, Gordon, McCoy & Granger

[57] ABSTRACT

A supplemental cover for and method of reinforcing a book with a spine, a first cover and a second cover is disclosed. The supplemental cover comprises a first sheet and a second sheet. The first sheet is stuff throughout. The second sheet comprises a flexible region and a stiff region. Both sheets are provided with a pressure-sensitive adhesive on one side. The first sheet is adhered to the first cover of the book. The flexible region of the second sheet is adhered to the spine of the book and the first sheet. The stiff region of the second sheet is adhered to the second cover of the book.

9 Claims, 1 Drawing Sheet

SUPPLEMENTAL BOOK COVER

This is a continuation-in-part of application Ser. No. 162,276, filed on Feb. 29, 1988, now abandoned.

BACKGROUND OF THE INVENTION

The present invention relates to a supplemental cover for and method of reinforcing the case of softbound books, particularly paperback books and school workbooks.

The cases on paperback books are not nearly as durable as those on hardbound books. When used in a library environment, paperbacks quickly fall apart. Various self-adhesive supplemental covers or jackets have been proposed to extend the usefulness and life of paperbacks, as well as damaged hardbound books.

For maximum protection, the supplemental cover needs to be stiff in the area of the front and back covers of the book. At the same time, the area of the book's spine, and particularly the hinges, need to be sufficiently flexible to allow opening and closing of the book without cracking or breaking from repeated use. The spine of the book is typically not subject to major stress, so a stiff reinforcement is not needed or desirable. Also, because the spine flexes substantially and is of relatively small surface area, a stiff reinforcement tends to separate from the spine.

Various single piece jackets and supplemental covers have been used. They all suffer from the problems associated with differing book thicknesses. Some one-piece designs are stiff throughout, except for a series of reduced thickness hinge lines. It is then required that the thickness of the book match some pair of hinge lines out of those available. Other one-piece designs employ stiff portions joined by a flexible portion that is centered on the spine in use. The flexible portion is unadjustable, so that on a thin book, the flexible portion may extend from the spine to a large portion of the front and back covers. These large portions of the front and back covers are then not suitably reinforced.

A two-piece self-adhesive supplemental cover has been used which consists of two identical sheets. Each sheet is divided into a cover portion and a spine portion. The spine portion is of reduced thickness. The spine portions have to be overlapped on the spine. If the spine portions extend beyond the spine, they should be trimmed, or can overlap on the cover portion of the opposite sheet. When overlapped on the spine, the curvature of the spine when flexed and the relatively small adhesive contact area tend to cause the spine portions to pull loose from each other and from the spine. It is a cumbersome process to apply these covers.

SUMMARY OF THE INVENTION

The disclosed supplemental cover comprises two sheets. The first sheet is a pressure-sensitive adhesive-backed sheet of relatively stiff, clear plastic material which is the size of, or larger than, the front or back cover of the book. This sheet is preferably adhered to the back cover of the book. The second sheet is also an adhesive-backed, clear plastic material and has a flexible region at least as long as and wider than the spine and a stiff region the size of, or larger than, the front or back cover of the book. In use, the stiff region of the second sheet is preferably adhered to the front cover of the book and the flexible region is adhered to the spine of the book and the additional width of the flexible region is preferably adhered to the first sheet already adhered to the back cover. A single thickness of flexible material is thus adhered to the spine, the covers of the book are reinforced and protected, and the flexible material provides hinges at the transition from cover to spine. The sheets may be made of transparent material. This allows the original case to show through the supplemental cover. The overlap of the second sheet on the first sheet occurs on the back cover where it is less noticeable and does not interfere with reading the front cover.

The method for reinforcing a book using the supplemental cover is simple and easy. The first sheet is cut to the size of the back cover. The narrow liner is removed from the first sheet, the first sheet aligned with the back cover and the exposed adhesive pressed against the cover. The remaining liner is then removed from the first sheet and the remainder of the adhesive surface is pressed against the back cover. Next, the second sheet is trimmed to the height of the book and the width of the stiff region trimmed to the width of the front cover of the book. The liner is removed from the flexible region of the second sheet. The junction of the stiff and flexible regions is then adhered to the junction of the front cover and the spine. The remaining portion of the flexible region is then adhered to the spine and wrapped around and adhered to the first sheet which was already adhered to the back cover. The liner is then removed from the stiff region of the second sheet and the exposed adhesive on the stiff region is then pressed against the front cover.

A book reinforced by this method exhibits strong, stiff covers with the supplemental cover well-bonded. It also has excellent, no-cracking hinging at the original locations rather than at a location dictated by the supplemental cover or jacket. In addition, the thin flexible region firmly bonds to the spine and cover, and complies with the bending and flexing of the spine during use of the book without becoming separated.

DESCRIPTION OF THE PREFERRED EMBODIMENT

Figure 1:
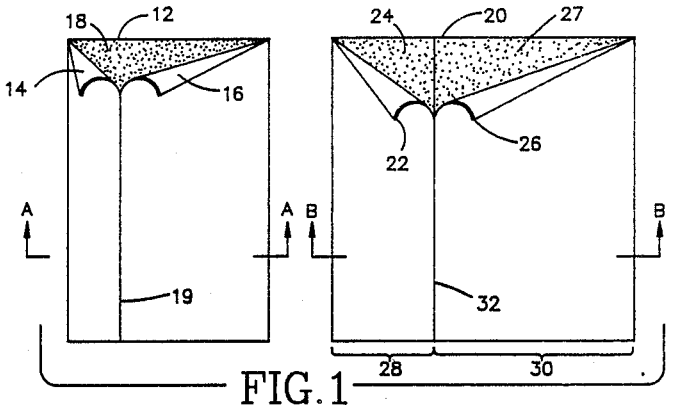
FIG. 1 is a plan view of the supplemental cover with a portion of the removable liners peeled back.

Referring to FIG. 1, a plan view of the disclosed supplemental two-piece cover is shown. It comprises a first sheet 12 and a second sheet 20. First sheet 12 is shown with release liner 14 and release liner 16 partially peeled back from adhesive layer 18. Release liner 14 preferably covers a smaller rectangular strip of first sheet 12 than release liner 16, which covers the remainder of first sheet 12. Release liner 14 may, for example, be a ¾ inch wide strip, as opposed to several inches for release liner 16. The dimensions of first sheet 12 should be equal to, or greater than, the dimensions of the front or back cover of the book to be covered, the line 19 between liners 14 and 16 being parallel to the book's hinges.

Second sheet 20 is shown with release liner 22 peeled back from adhesive layer 24 and release liner 26 peeled back from adhesive layer 27. Release liner 22 covers the rectangular strip indicated as flexible region 28. Release liner 26 covers rectangular stiff region 30. The dimensions of stiff region 30 should be equal to, or greater than, the front or back cover of the book to be covered, the dividing line 32 between stiff region 30 and flexible region 28 being parallel to the book's hinges. The dimension of flexible region 28 along line 32 should be equal to, or greater than, the height of the spine of the book. The dimension of flexible region 28 perpendicular to line 32 should substantially exceed the width of the spine, or equivalently the thickness of the book.

Figure 2A:
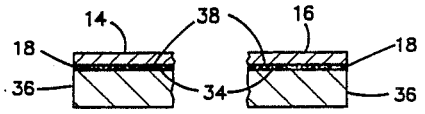
FIG. 2A is a broken cross-sectional view along line A—A in FIG. 1.

FIG. 2A shows the construction of first sheet 12 in more detail. The outside surface 34 (outside denotes the side furthest from the cover of the book in the installed invention) of adhesive layer 18 is adhered to stiff sheet 36. First and second release liners 14, 16 are removably adhered to the inside surface 38 of adhesive layer 18.

Figure 2B:
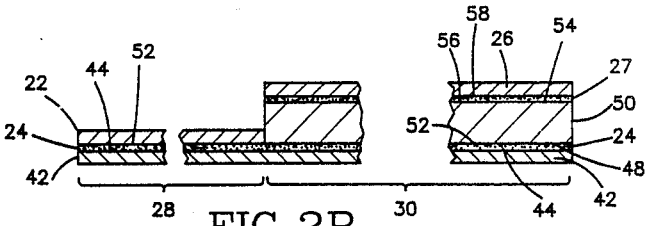
FIG. 2B is a broken cross-sectional view along line B—B in FIG. 2.

FIG. 2B shows the construction of second sheet 20 in more detail. Flexible layer 42 is adhered to outside surface 44 of adhesive layer 24. The outside surface 48 of stiff layer 50 is adhered to the inside surface 52 of adhesive layer 24. Flexible layer 42 extends throughout second sheet 20, while stiff layer 50 only extends throughout stiff region 30 and is coincident therewith. Flexible region 28 of second sheet 20 corresponds to the portion of second sheet 20 where stiff layer 50 is absent. The outside surface 54 of adhesive layer 27 is adhered to the inside surface 56 of stiff layer 50. Release liner 22 is removably adhered to inside surface 52 of adhesive layer 24 coincident with flexible region 28. Release liner 26 is removably adhered to outside surface 58 of adhesive layer 27 coincident with stiff region 30. In use, the portion of adhesive layer 24 within flexible region 28 along with adhesive layer 27 act as a single adhesive layer for installing sheet 20 on a book.

Stiff sheet 36 and stiff layer 50 are made of a suitably stiff plastic material, such as a clear 19 vinyl plastic material of 10 mils thickness. Use of a clear material allows access to the original text and graphics on the original case. Flexible layer 42 is made of a suitably flexible plastic material, such as a clear polyester plastic material of 2 mils thickness. Adhesive layers 18, 24, and 27 are pressure-sensitive adhesives suitable to bond sheets 12, 20 to a book or each other, such as a clear acrylic adhesive. Liners 14, 16, 22, 26 are made of a material suitable for temporarily protecting adhesive layers 18, 24, and 27, such as 40 pound paper stock with a silicon release coating.

The plastic material useful for the purpose of the stiff sheet of this invention includes sheets of thermoplastic resins derived from various known polymeric materials, including polyvinyl acetate, polyvinyl chloride, and the polyolefins, such as polyethylene, polypropylene, and the various copolymers thereof. These polymeric or plastic materials preferably are used in sheet form at thicknesses ranging from about 7 to 12 mils, and may be either clear or transparent, or, alternatively, translucent sheets of plastic. The plastic sheets are coated with an effective amount of an adhesive applied to the substrate in an amount sufficient to adhere the sheet material to the book cover. Various adhesives known in the art are useful for purpose of this invention. However, the pressure-sensitive adhesives are preferred for preparing the self-adhesive flexible sheets for use in accordance with this invention. The plastic material useful for the purpose of the flexible sheet includes polyester resins such as Mylar and clear polypropylene.

Figure 3:
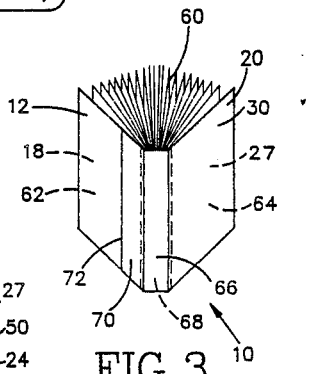
FIG. 3 is a perspective view of the supplemental cover installed on a book.
Figure 4:
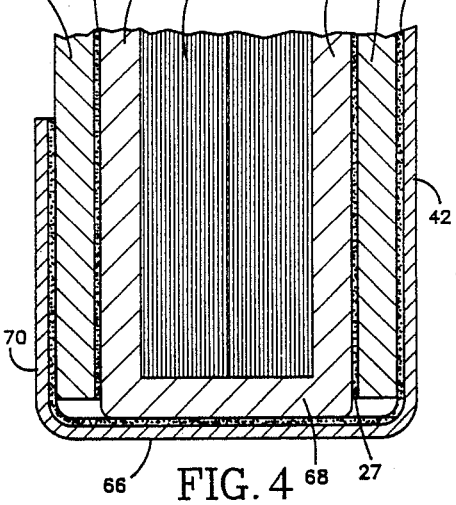
FIG. 4 is a broken cross-sectional view of the supplemental cover installed on a book using the method disclosed.

FIG. 3 shows the assembled supplemental cover 10 installed on a book 60. First sheet 12 is permanently adhesively bonded by adhesive layer 18 coincident with back cover 62 of book 60. Stiff region 30 of second sheet 20 is permanently adhesively bonded by adhesive layer 27 coincident with front cover 64 of book 60. A first portion 66 of flexible region 28 is permanently adhesively bonded by adhesive layer 24 to spine 68 of book 60 and the remaining portion 70 of flexible region 28 to first sheet 12. Edge 72 of flexible region 28 is firmly bonded to first sheet 12 and presents a minimal edge to catch on other books and the like. A cross-sectional view of supplemental cover 10 installed on book 60 is shown in FIG. 4. By having edge 72 on back cover 62, front cover 64 is covered by an unbroken surface (stiff region 30). When sheets 12, 20 are advantageously made of a transparent material, front cover 64 is readable through stiff region 30 without any distracting lines such as edge 72.

Figure 5:
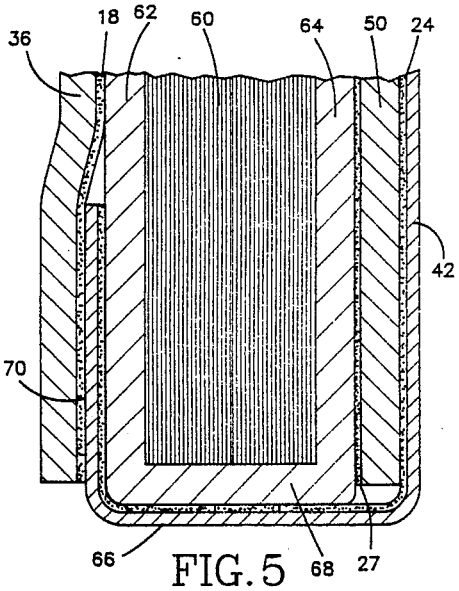
FIG. 5 is a broken cross-sectional view of the supplemental cover installed on a book using an additional disclosed method.

Alternatively as shown in FIG. 5, remaining portion 70 of flexible region 28 may be permanently adhesively bonded by adhesive layer 24 to back cover 62. In this case, first sheet 12 is permanently adhesively bonded by adhesive layer 18 to back cover 62 and remaining portion 70.

To reinforce book 60 as shown in FIGS. 3 and 4 is simple and easy to do. First sheet 12 is cut to the size of back cover 62. Then liner 14 is peeled off first sheet 12 and the exposed portion of adhesive layer 18 is pressed against back cover 62, superimposing first sheet 12 on back over 62. Liner 16 is then removed from first sheet 12 and the remainder of adhesive layer 18 pressed against back cover 62. As a result first sheet 12 is permanently bonded to back cover 62.

Second sheet 20 is then trimmed so that its length (parallel to dividing line 32) matches the length of book 60 (parallel to the book's spine and cover junctions, i.e., hinges or broken hinges) and so that stiff region 30 is the same width (perpendicular to the spine and cover junctions) as front cover 64. Liner 22 is then peeled from second sheet 20. Thereby exposed adhesive layer 24 on flexible region 28 is then pressed against spine 68 starting with line 32 placed contiguous with the junction between front cover 64 and spine 68 and continuing perpendicularly from line 32 across spine 68 and around to first sheet 12. As a result first portion 66 of flexible region 28 is permanently bonded to spine 68 and remaining portion 70 of flexible region 28 is permanently bonded to first sheet 12.

Liner 26 is then removed from second sheet 20. Thereby exposed adhesive layer 27 on stiff region 30 is then pressed against front cover 64. As a result, stiff region 30 of second sheet 20 is permanently bonded to front cover 64.

It is of course possible to trim sheets 12, 20 after they have been applied to book 60 instead of before.

An additional method of applying supplemental cover 10 to book 60 is to apply second sheet 20 first and first sheet 12 second as shown in FIG. 5. Liner 22 is peeled from second sheet 20. Thereby exposed adhesive layer 24 on flexible region 28 is then pressed against spine 68 starting with line 32 placed contiguous with the junction between front cover 64 and spine 68 and continuing perpendicularly from line 32 across spine 68 and around to back cover 62. As a result, first portion 66 of flexible region 28 is permanently bonded to spine 68 and remaining portion 70 of flexible region 28 is permanently bonded to back cover 62.

Liner 26 is then removed from second sheet 20. Thereby exposed adhesive layer 27 on stiff region 30 is then pressed against front cover 64. As a result, stiff region 30 of second sheet 20 is permanently bonded to front cover 64.

Then liner 14 is peeled off first sheet 12 and the exposed portion of adhesive layer 18 is pressed against back cover 62, superimposing first sheet 12 on back cover 62. Liner 16 is then removed from first sheet 12 and the remainder of adhesive layer 18 pressed against back cover 62 and portion 70 of flexible region 28. As a result, first sheet 12 is permanently bonded to back cover 62 (including portion 70 of flexible region 28).

It is of course possible to interchange back cover 62 for front cover 64, and vice versa, in the foregoing descriptions.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any way that is inconsistent with the extent to which the progress in the art has been advanced by the invention.

What is claimed is:

1. A method for reinforcing a book with a spine, a first cover and a second cover, comprising the steps of: removing a first liner from a portion of an adhesive-backed stiff first sheet; adhering the thereby exposed portion to the second cover; removing a second liner from the remainder of the first sheet; adhering the thereby exposed portion to the second cover; removing a third liner from a flexible region of the second sheet; adhering a part of the thereby exposed flexible region to the spine and the remaining part of the flexible region to the first sheet; and removing a fourth liner from a stiff region of an adhesive-backed second sheet; and adhering the thereby exposed stiff region to the first cover.

2. A method as described in claim 1, further comprising the steps of trimming said first sheet to the size of the second cover and trimming said second sheet to the length of the book and the width of the stiff region to the width of the first cover.

3. A method for reinforcing a book with a spine, a first cover and a second cover, comprising the steps of: removing a first liner from a flexible region of an adhesive-backed first sheet; adhering a part of the thereby exposed flexible region to the spine and the remaining part of the flexible region to the first cover: removing a second liner from a stiff region of the first sheet; adhering the thereby exposed stiff region to the second cover; removing a third liner from a portion of an adhesive-backed stiff second sheet; adhering the thereby exposed portion to the first cover; removing a fourth liner from the remainder of the second sheet; and adhering the thereby exposed portion to the first cover and the second part of the flexible region.

4. A method as described in claim 3, further comprising the steps of trimming said second sheet to the size of the second cover and trimming said first sheet to the length of the book and the width of the stiff region to the width of the first cover.

5. A book protected from wear due to repeated use, comprising:

(a) front and back covers, a spine connecting said covers, and pages between said covers which are secured to the spine;

(b) a rectangular, stiff first sheet affixed by pressure-sensitive adhesive to the outside of one of the covers;

(c) a rectangular, stiff second sheet affixed by pressure-sensitive adhesive to the other of the covers, said second sheet having a flexible flap which is affixed by pressure-sensitive adhesive to the spine of the book and to the portion of the first sheet adjacent the spine;

(d) whereby said flap provides a single thickness of flexible material covering on said spine and said stiff first and second sheets protect the covers.

6. The book of claim 5, in which the first and second sheets including the flexible flap of the second sheet are transparent.

7. The book of claim 5, in which the first and second sheets are about 10 mils thick and the flexible flap is about 2 mils thick.

8. A reinforced book case comprising: a spine; a first cover; a second cover; a stiff first sheet having a first pressure-sensitive adhesive layer on one side adhering between said first sheet and said second cover; and a second sheet having a flexible region, a stiff region and a second pressure-sensitive adhesive layer on one side of said second sheet, said second adhesive layer adhering between said stiff region and said first cover and between said flexible region and both said spine and one of said first sheet and said second cover.

9. A reinforced book case in accordance with claim 8, in which the stiff first sheet and stiff region of the second sheet are about 10 mils thick and the flexible region of the second sheet is about 2 mils thick, and said first and second sheets are transparent.

* * * * *